US006422909B2

(12) United States Patent
Clever et al.

(10) Patent No.: US 6,422,909 B2
(45) **Date of Patent: *Jul. 23, 2002**

(54) GENDERLESS CONSTRUCTION SYSTEM

(76) Inventors: Eric Clever; Ray Lyons, both of 29 Estaugh Ave., Haddonfield, NJ (US) 08033

( * ) Notice: Subject to any disclaimer, the term of this patent is extended or adjusted under 35 U.S.C. 154(b) by 0 days.

This patent is subject to a terminal disclaimer.

(21) Appl. No.: 09/855,265

(22) Filed: May 15, 2001

Related U.S. Application Data

(63) Continuation of application No. 09/359,204, filed on Jul. 22, 1999, now Pat. No. 6,231,416, which is a continuation of application No. 08/862,948, filed on May 30, 1997, now abandoned.

(60) Provisional application No. 60/018,771, filed on May 31, 1996.

(51) Int. Cl.[7] ..... A63H 33/08

(52) U.S. Cl. ..... 446/108; 446/111; 446/114; 446/125; 446/126

(58) Field of Search ..... 446/85, 106, 108, 446/111, 112, 114, 120, 121, 125, 126, 127

(56) References Cited

U.S. PATENT DOCUMENTS 1,113,371 A * 10/1914 Pajeau
2,633,662 A * 4/1953 Nelson
2,984,935 A * 5/1961 Beck
4,758,196 A * 7/1988 Wang ..... 446/104
D304,217 S * 10/1989 Klitsner ..... D21/104
4,902,259 A * 2/1990 Ziegler ..... 446/117
5,049,105 A * 9/1991 Glickman ..... 446/126
5,061,219 A * 10/1991 Glickman ..... 446/126
5,183,409 A * 2/1993 Clever et al. ..... 439/291
5,322,467 A * 6/1994 Barzani ..... 446/125
5,769,681 A * 6/1998 Greenwood, Sr. et al. .. 446/120
6,231,416 B1 * 5/2001 Clever et al. ..... 446/108
6,325,694 B1 * 12/2001 Clever et al. ..... 446/104

* cited by examiner

*Primary Examiner*—Jessica Harrison
*Assistant Examiner*—Alex F. R. P. Rada, II
(74) *Attorney, Agent, or Firm*—Norman E. Lehrer

(57) ABSTRACT

A suite of construction toy systems in which mechanical connection is provided by hermaphroditic and functionally identical (genderless) connectors. Both hub-and-rod and building-block construction toy systems are disclosed. In the hub-and-rod construction systems, the use of genderless connectors allows: rods to connect directly to rods by the same means rods connect to hubs (longer rods can be directly formed out of shorter rods); hubs to connect to hubs by the same means that rods connect to hubs; and, in some assemblies hubs to be substituted for rods. An additional useful feature of the genderless connectors used and of the overall design of these toy systems is that many of the different construction toy systems disclosed herein will inter-connect. By the application of this invention, a very wide range of very different and independent toy systems can be designed that freely inter-connect.

3 Claims, 14 Drawing Sheets

Fig. 3
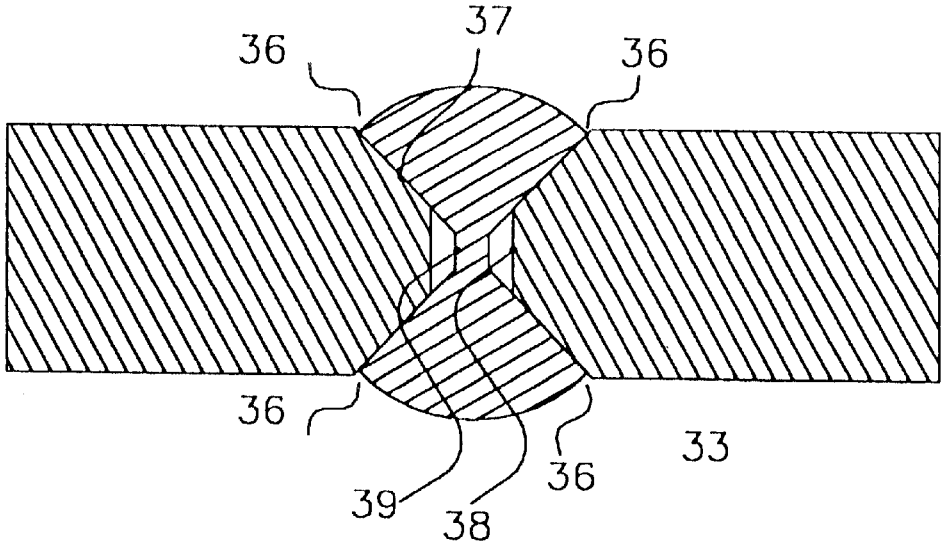
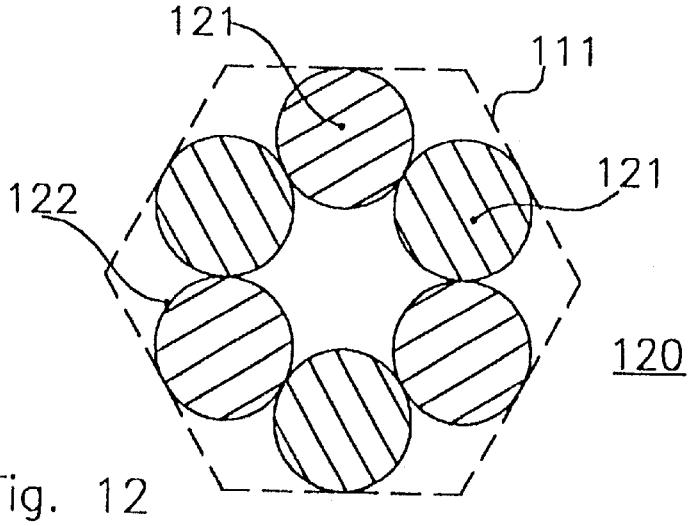
Fig. 12

Fig. 20a
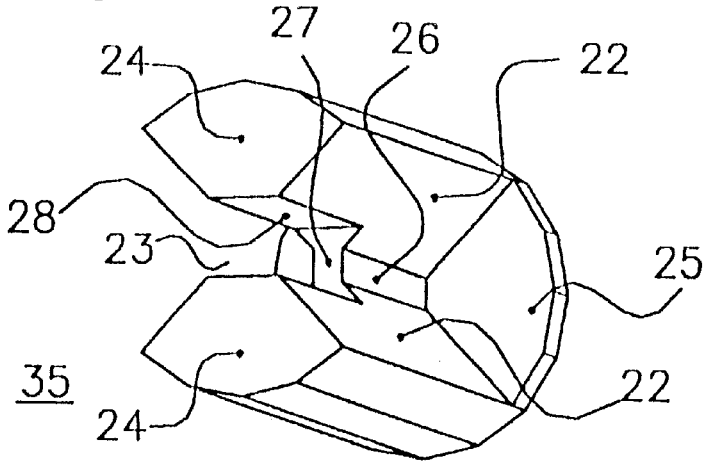
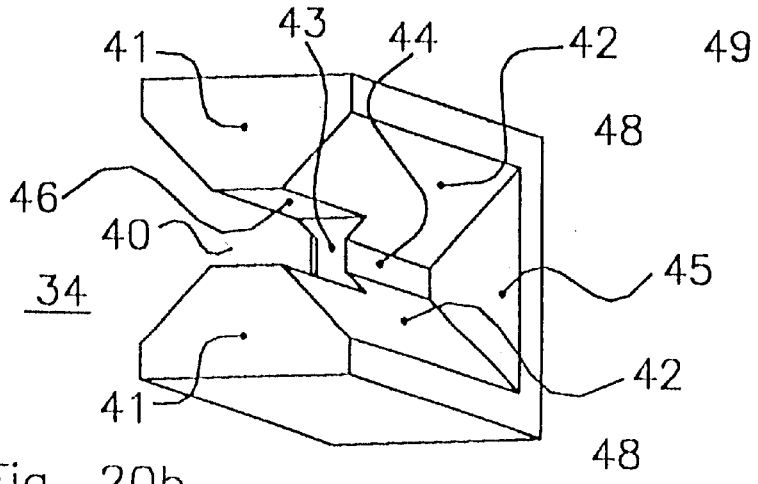
Fig. 20b
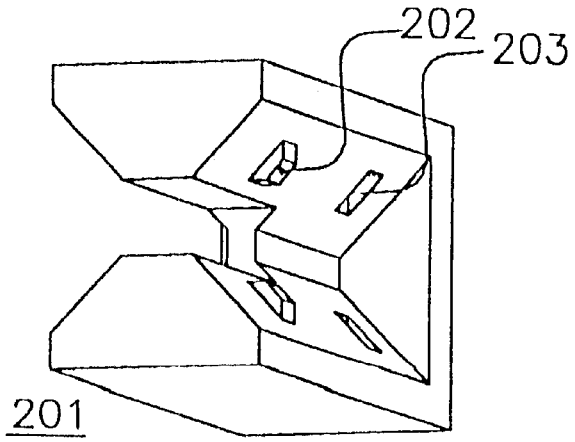
Fig. 20c

GENDERLESS CONSTRUCTION SYSTEM

CROSS-REFERENCE TO RELATED APPLICATION

This application is a continuation of prior application Ser. No. 09/359,204, filed July. 22, 1999, now U.S. Pat. No. 6,231,416, which was a continuation of application Ser. No. 08/862,948, filed May 30, 1997, now abandoned, which claimed the benefit of provisional patent application Ser. No. 60/018,771, filed May 31, 1996.

TECHNICAL FIELD

This invention relates to construction toy systems. More particularly, it relates to both hub and rod construction toy systems based on hermaphroditic and identical (genderless) connectors, and to building block systems also based on genderless connectors. In many cases the genderless connectors are integral to the parts being connected. And the genderless connectors greatly extend the range of applications for this invention.

BACKGROUND ART

This is a crowded art with much activity in the construction toy system part of it, with many U.S. patents, referred to by number below, known to the inventor which have some pertinence. U.S. Pat. No. 1,113,371 discloses the original rod and hub construction toy system with wooden hubs and rods and with the rod inserted into a hole in the hub and held there by friction and compression (interference fit). U.S. Pat. No. 1,707,691 discloses a hub and rod construction toy system with a hub of stamped metal and wooden rods with slit ends. The connection is formed by inserting the metal hub into the rod-end slit. A great many construction toy systems allow identical elements to be interconnected but with only a few exceptions noted below the actual connections are not genderless. Instead, the male and female connecting elements are placed on opposite ends of the block or hub. In any event, we found no construction system that allowed genderless connection between non-identical elements, e.g., between hub and rod. U.S. Pat. No. 3,626,632 discloses a typical building block system that allows identical blocks to be interconnected by means of a male element on one side and female elements on three other sides. But U.S. Pat. No. 2,800,743 discloses a nearly genderless building block system. But in this system when genderless connections are made the elements are no longer aligned and regular figures can not be constructed. U.S. Pat. No. 2,633,662 discloses a construction toy system with genderless interconnection for hubs connected orthogonally. But hub and rod connections in the same plane are effected with rods that connect across the face of the hubs and do not form a genderless connection. U.S. Pat. No. 4,758,196 discloses a hub and rod construction toy system with genderless rod—rod connections but without any way of directly connecting the hubs.

Various concepts from the construction and other industries have been adapted to construction toy systems. U.S. Pat. No. 3,648,404 discloses a hub and rod construction system designed to be used with hollow rods. The construction toy system disclosed in U.S. Pat. Nos. 4,078,328 and 5,049,105 uses a similar connection system. U.S. Pat. No. 3,891,335 discloses a hub and rod and panel snap together construction system. The hub and rod construction toy system disclosed in U.S. Pat. Nos. 5,061,219, 5,137,486 and 5,199,919 uses a retaining clip similar to the one disclosed in the 335 patent. The 486 patent does disclose a genderless hub—hub connection for orthogonally connecting hubs. However, the means of connecting the hubs is not the same means as connecting rods to hubs.

Other mechanical connectors include U.S. Pat. No. 4,280,339, which discloses a torque transfer device for flexible shaft couplings. Each shaft has an extended portion with forked ends defining teeth. The teeth are inserted orthogonally to each other. U.S. Pat. No. 3,800,556 discloses a power shaft coupling including a coupling mechanism having elongate square bars defining extensions. These extensions may be mutually inserted in orthogonal positional relationship. U.S. Pat. No. 2,577,508 is a universal coupling with bifurcated tongues that mate. U.S. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

Hermaphroditic connectors have been used in the electronic connector industry. The invention disclosed herein grew out of our prior electronic connector inventions. See Clever and Lyons U.S. Pat. No. 5,183,409 and continuation in part application Ser. No. 08/011,994.

Other presently known U.S. patents having interest are: U.S. Pat. Nos. 3,516,043; 3,070,769; 2,690,542; 3,011,143; 4,199,208; 3,634,811; 2,996,026; 3,070,769; 2,475,046; 2,470,282;1,865,300; 2,577,508; 607,607; 3,552,145; 1,171,380; 2,740,271; 4,172,369; 2,460,231; 534,732, and 2,389,115. It is believed that the present invention is patentably distinct from the teachings of any of the above-cited Patents.

DISCLOSURE OF THE INVENTION

We disclose a suite construction toy systems all of whose parts directly interconnect by means of genderless connectors. Said connectors are usually integral to the parts being connected. We also disclose a method of designing the genderless connectors, all of whose preferred embodiments have the same conceptual basis.

Very briefly, the design of the genderless connectors starts with a regular prism which we will divide into two equal and identical halves: part A and part B. This division or parting will use cuts or parting lines that are parallel to the principal axis of the prism and other cuts that are perpendicular to the axis. As a result of this parting the ends of the prisms are undisturbed, i.e., no parting line goes all the way to the end of the prism, and part A can be separated from part B but only in the direction of the principal axis. Each of part A and part B form the basis for a genderless connector design. And in general the connection is formed by matching fingers that interdigitize.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

FIG. 3 shows a cross section of the connecting region (conplan) of a hub and rod.

In FIG. 4 the rods are not fully inserted.

FIGS. 11 and 12 are conplans of the embodiments shown in FIGS. 9 and 10. They show rod-hub and rod—rod conplans respectively.

FIGS. 20*a* through 20*c* are details of FIG. 1.

BEST MODE FOR CARRYING OUT THE INVENTION

Figure 1:
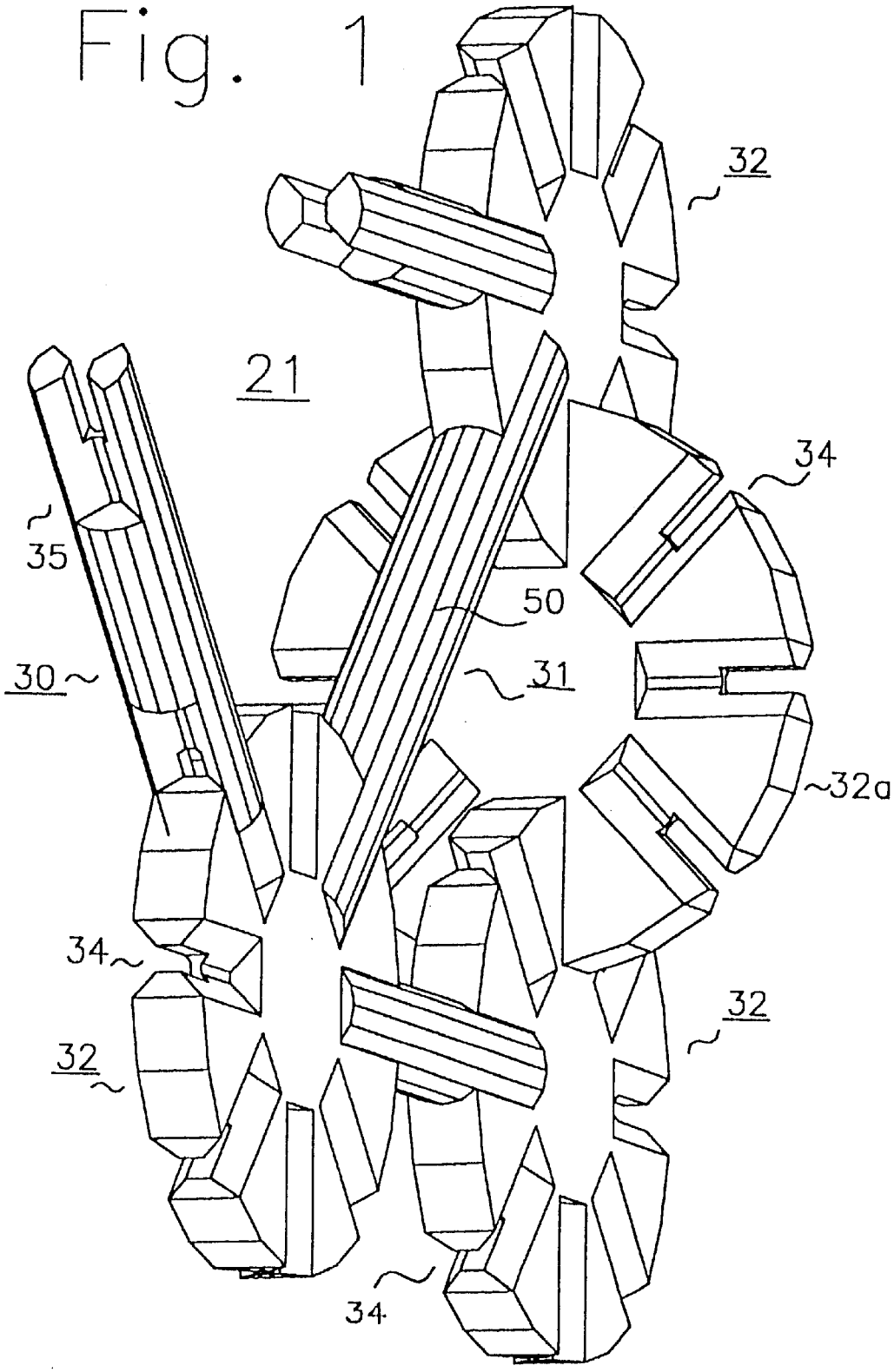
FIGS. 1 and 2 show in perspective and plan views respectively, a rod and hub assembly.

All of the embodiments disclosed are construction toy systems. The application of these inventions to construction systems is disclosed in related applications.

All of the preferred embodiments described below use genderless connectors. All of the embodiments shown in perspective view use genderless connectors. All of the embodiments whose conplans are shown use genderless connectors. Further, all of the preferred embodiments are comprised of integral genderless connectors except for hub 181 shown in perspective view in FIG. 18.

The design of said integral genderless connectors starts with a regular prism of square or hexagonal or other cross section. In the case of a cylinder one of the other cross sections is also used, e.g., a square with said cylinder inscribed in said square. Said cross section is a 'floorplan' on which we will design a cross section of the connecting region. For the sake of brevity we will substitute the term 'conplan' for: 'cross section of the connecting region.' Note that both floorplans and conplans are sections taken perpendicular to the major axis of a prism. To design a conplan we start by drawing lines from each vertex of said floorplan to the center of said floorplan. In the case of a square, said lines form an 'x' and said floorplan has been divided into four equal triangles. For a 'square x' connector described below said lines form the basis of the 'parting lines.' That is to say that said lines are used to find parting lines but are not identical to them. Said parting lines indicate cuts perpendicular to a floorplan that are used, along with other cuts parallel to said floorplan, to separate a prism into two equal and identical parts.

We continue with a parting that consists of parting cuts that divides said prism into two equal and identical parts, part A and part B, which parts can be pulled apart only in a direction parallel to a major axis of said prism. Said parting leaves said floorplans undisturbed.

Said parting includes parting cuts or excursions that cut said prism parallel to said principal axis of said prism and excursions that cut said prism perpendicular to said principal axis, such that said prism is cut into two pieces, by both parallel and perpendicular cuts or excursions, one piece in A and one piece in B. And said parallel excursions provide surfaces of connection. Which is to say that they form those parts of the connector where a mechanical connection is actually made when said two parts are brought back together.

In the preferred embodiments said parting creates an equal number of fingers in part A and part B. Each of said fingers is of the same length and all point in a direction parallel to said principal axis. Said fingers are placed uniformly and equidistant about said axis. Said parting cut or excursion parallel to said principal axis forms the surfaces of connection, e.g., mating surface 22 in FIG. 1, for both of said parts A and B. A parting cut perpendicular to said principal axis that forms one of said finger tips of part A (e.g., the distal tip 24 in FIG. 1) forms a proximal seat in part B (e.g., proximal seat 25 in FIG. 1).

If a compact rectangular array of connecting elements is needed then the design process starts with a compact rectangular array of identical prisms whose individual floorplans can tile the plane. The application of said rectangular arrays to construction systems and to construction toy systems is disclosed in related applications.

The above is a conceptual description of the initial design process. Most of the partings of the preferred embodiments would not be possible with actual cuts made with any known tool. Other design constraints, such as the need to guarantee an interference fit, also mitigate against using the parting as an actual manufacturing method. However, in some circumstances manufacturing methods that resemble the parting could be used in order to minimize scrap.

Figure 13:
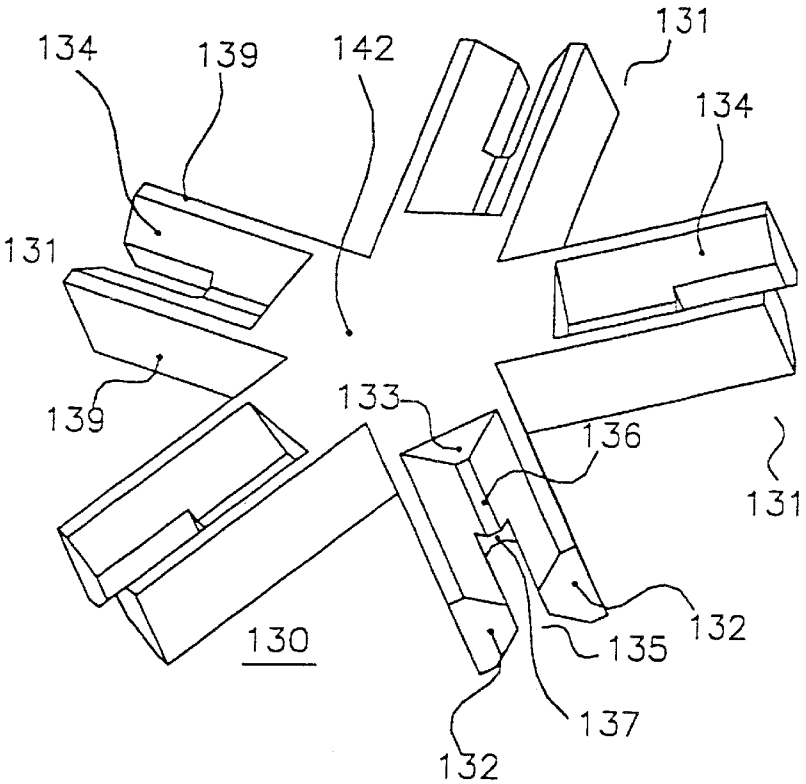
FIGS. 13 and 14 show in perspective view, hubs furnished with five and six genderless connectors respectively. When these embodiments are molded of flexible material they are suitable for constructing geodesics.
Figure 14:
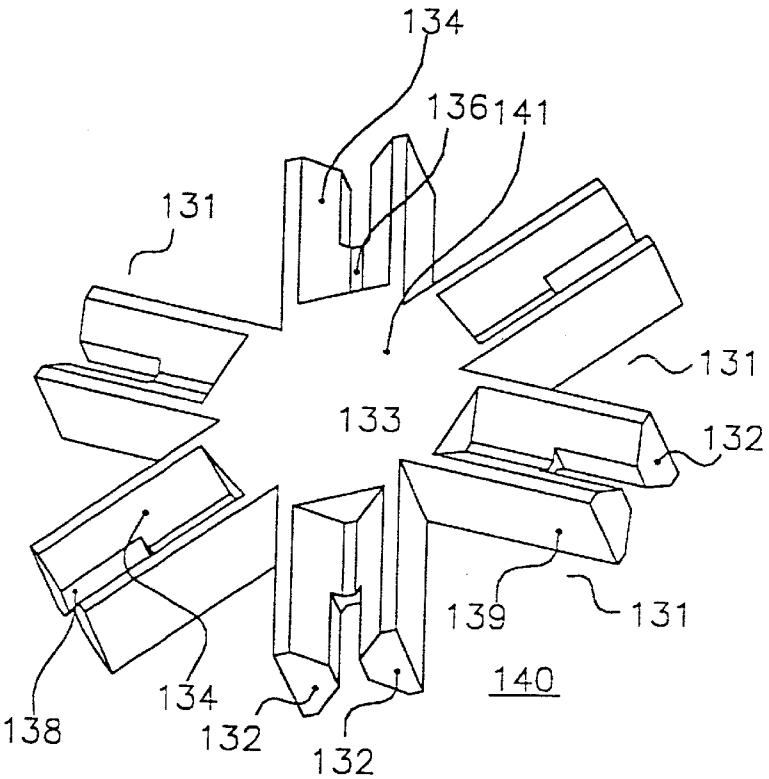
Figure 18:
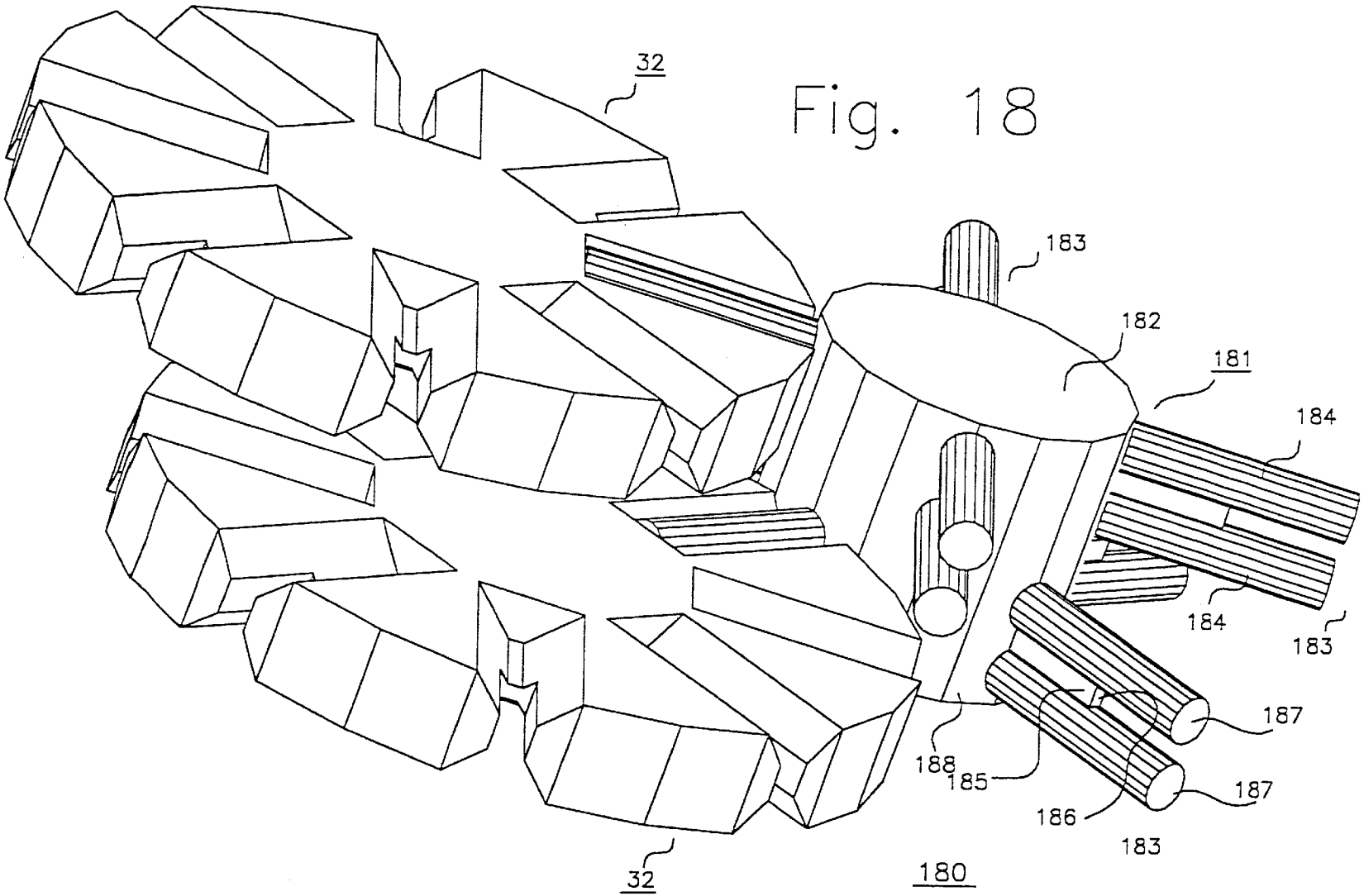
FIG. 18 shows in perspective view a hub to be used with the embodiments shown in FIGS. 1 thru 8 and 13 and 14.

Some of the embodiments of the invention disclosed herein are rod and hub construction toy systems. As is usual with said rod and hub construction toy systems said rods are elongated cylinders and said hubs are in the form of a flattened cylinder or disc. But other forms are possible. In FIGS. 9 thru 12 we show embodiments of the invention that have rods 93 with a square cross section. Other rod cross sections are possible: triangular, rectangular, hexagonal, ellipsoid, cruciform, etc. In FIGS. 13 and 14 we show embodiments in which the disclike form of hubs 130 and 140 is not necessarily evident. In FIG. 18 we show an embodiment in which a cylindrical hub 181 is not flattened enough to be considered disclike.

In most of our preferred embodiments genderless connectors are integral to said rods or said hubs. But cylindrical hub 181 has free-standing genderless connectors 183 consisting of two round fingers 184 attached directly to a cylinder wall 188.

In the embodiment of the invention shown in FIG. 1 thru FIG. 6 and FIGS. 20*a* and 20*b*, hub integral connector 34 could be directly machined into the material of hubs 32 or 32*a*. Also, rod integral connector 35 could be directly machined into the material of rods 30 or 31.

In said hubs, integral connectors have an appearance of grooves radiating from the center of said hubs. Each integral connector 34 consists of a pair of grooves, one in the top surface of said hubs 32 and 32*a* and one directly aligned with it in the bottom surface of said hub.

Figures 19A, 19B, 19C:
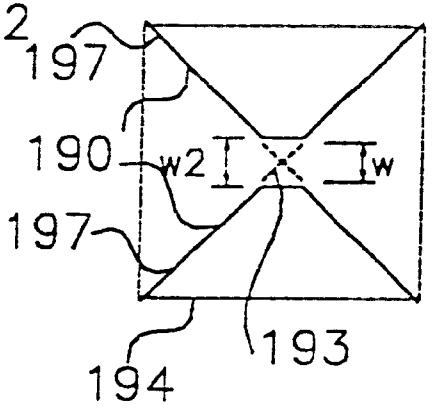
FIGS. 19*a* through 19*c* show tool profiles et cetera for the construction of the genderless connectors of several of the embodiments.

A profile 190 for a cutting tool suitable for machining grooves that produce mating surfaces 42 for hubs 32 and 32*a* is shown in FIG. 19*a*. If said hubs are fabricated from metal by Electronic Discharge Machining (EDM) then an EDM wire can take the shape of profile 190. An end-mill of said profile could also machine said grooves but a proximal seat 43 would have as its shape a semi-cone void.

In FIGS. 19*b* and 19*c* we show profile-pairs 191 and 197 both composed of profiles 190. If parts were machined in accordance with profile-pair 191 they would inter-mate with a perfect-fit or possibly a slip-fit. But if parts were machined in accordance with profile-pair 197 they would inter-mate with an interference fit. If, however, said profiles 190 were brought together closer than a reference distance w, a loose fit would be the result.

Said hubs and rods can be formed from plastic or metal or any other suitable material and can be solid or hollow. Said hubs and rods can be fabricated by injection molding or blow molding plastic, by die casting metal, by stamping or coining or by machining any suitable material.

We also show an embodiment of the invention in FIGS. 9 thru 12 in which the hub 92 is furnished with eight (8) integral genderless connectors 106 having three (3) fingers 96 each. But rods 93 have free-standing genderless connectors 106 similar to genderless connectors 183 but with three (3) fingers 101.

Figure 15:
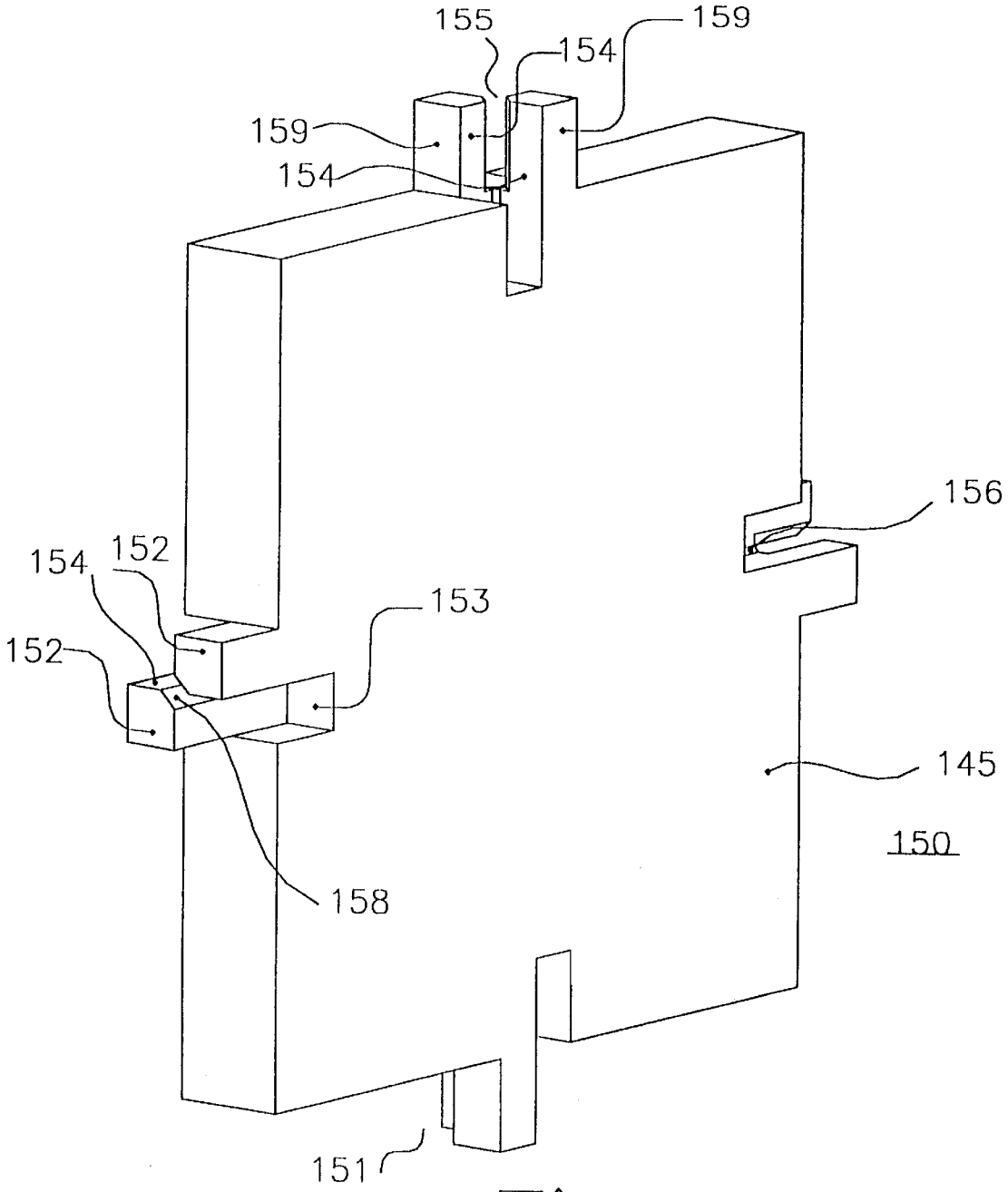
FIG. 15 shows in perspective view a genderless building block
Figure 17:
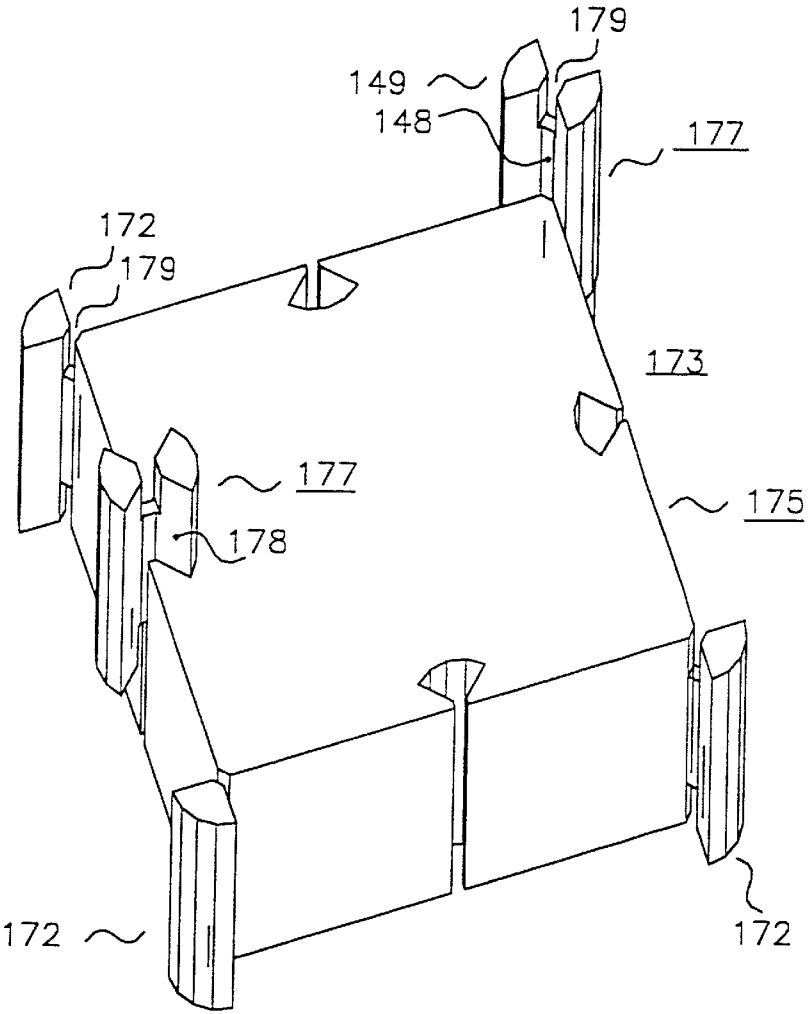
FIG. 17 shows in perspective view a building block to be used with the embodiment shown in FIG. 16 as well as with the embodiments shown in FIGS. 1 thru 8, 13 and 14.
Figure 16:
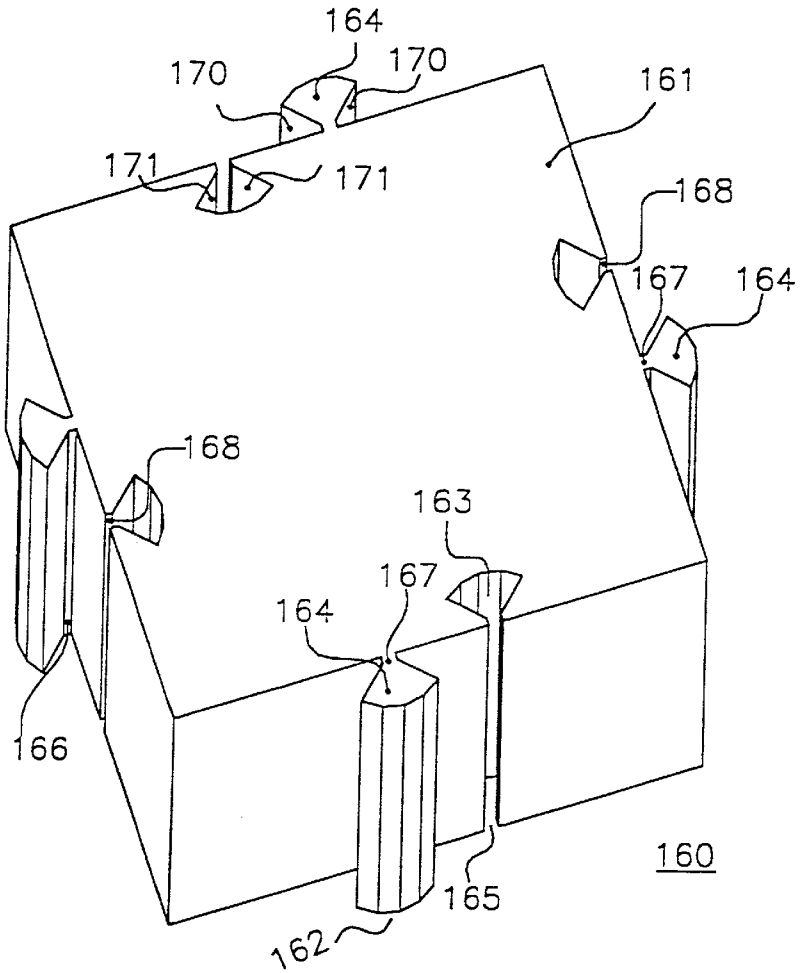
FIG. 16 shows in perspective view a different genderless building block.

Two (2) building block toy systems shown in FIG. 15 and FIGS. 16 and 17, respectively, have blocks furnished with integral genderless connectors, but said connectors could only be machined into their respective blocks by removing a great deal more material than would be necessary for hub 32.

Integral genderless connectors 151 of block 150 are similar enough to hub genderless connector 34 and rod genderless connector 35 that they will mate with them over a wide range of sizes. But fingers 159 are both integral to said block and obtrude from it, with half the length of said fingers in said block and half protruding. Said fingers are normal to the side of said block. Also, hub 32 has the principal plane of connectors 34 aligned with the principal plane of said hub. But the principal plane of connectors 151 is aligned at an angle of forty-five (45) degrees to the principal plane of block 150. Said alignment allows said blocks to be connected in the same plane and with their block bodies 145 touching.

Rod 177 shown as part of a rod and block assembly 173 in FIG. 17 is similar to rod 30 and rod 31 but the groove that forms its connecting surface 178 goes the entire length of said rod. We can note here that rod 177 is the only exception shown here to the general rule that a parting leaves the ends of the prism undisturbed. Block 175 can be described as block body 176 with a semi-rod 172, vertically aligned, added to its vertical corners and subtracted from the center of its vertical faces. Semi-rod 172 is equal to half of rod 177 split length-wise. Said semi-rod has one finger 149 plus half a web 148. Block 160 can be described in a similar fashion with semi-rod 172 added to the vertical faces of block body 161 and positioned slightly offset from the center. Said semi-rod is also subtracted from said vertical faces and positioned slightly offset from the vertical center of said faces by the same amount but in the opposite direction as said semi-rods which were added to said faces.

Figure 7:
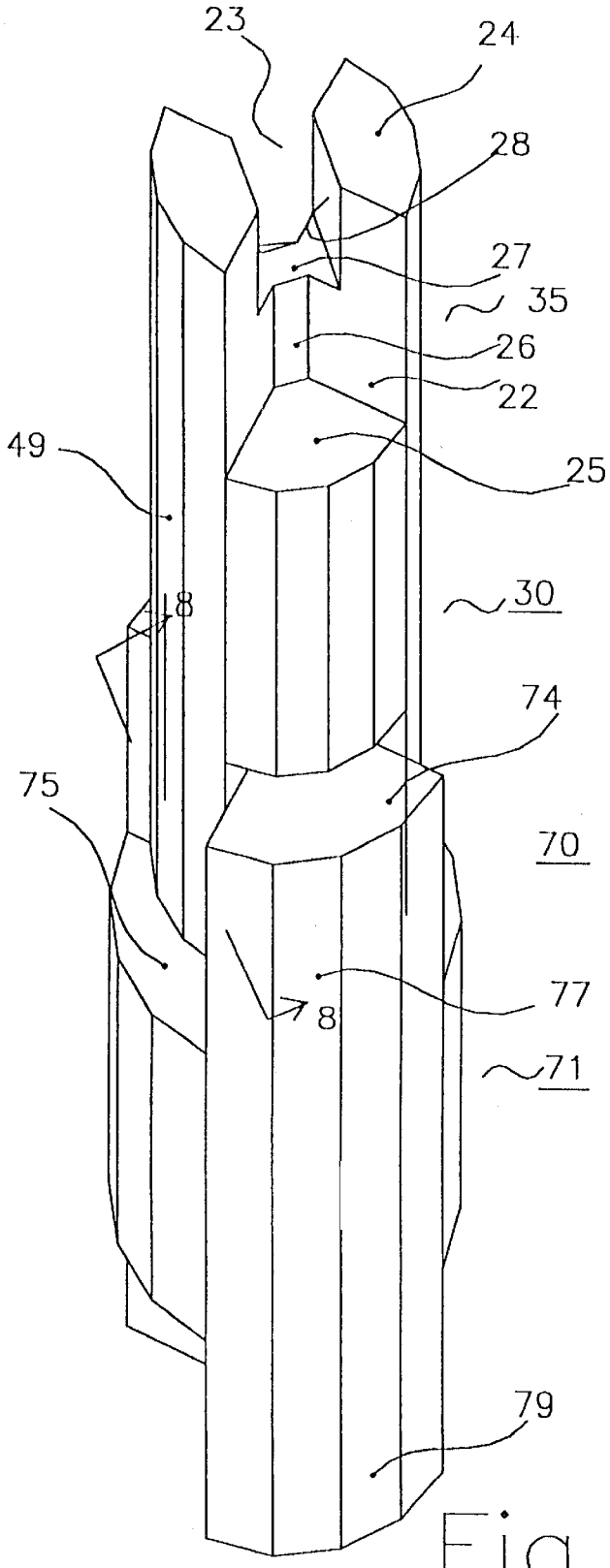
FIG. 7 shows in perspective view a rod assembled from shorter rods of different diameters.

We should also note that it is an object of this invention to provide interconnectivity over a wide range of connector sizes. A square-x connector can provide said inter-connectivity as long as web sections are kept small enough to accommodate slot widths of smaller connectors. If additional means other than interference fit is used to hold said connectors together then said means should also be sized so as to accommodate said inter-connectivity. For example, integral hub connector 201 shown in perspective view in FIG. 20*c* has locking bumps 202 and pits 203. A smaller connector might be sized to miss said pits and bumps. A larger connector could use identically sized and positioned pits and bumps. In either case inter-connectivity would be maintained. We illustrate said inter-connectivity with rod assembly 70 composed of rods of different diameters connected together. Said rod assembly 70, shown in perspective view in FIG. 7, shows two rods (rod 30 and rod 71) of different diameters connected together.

Figure 2:
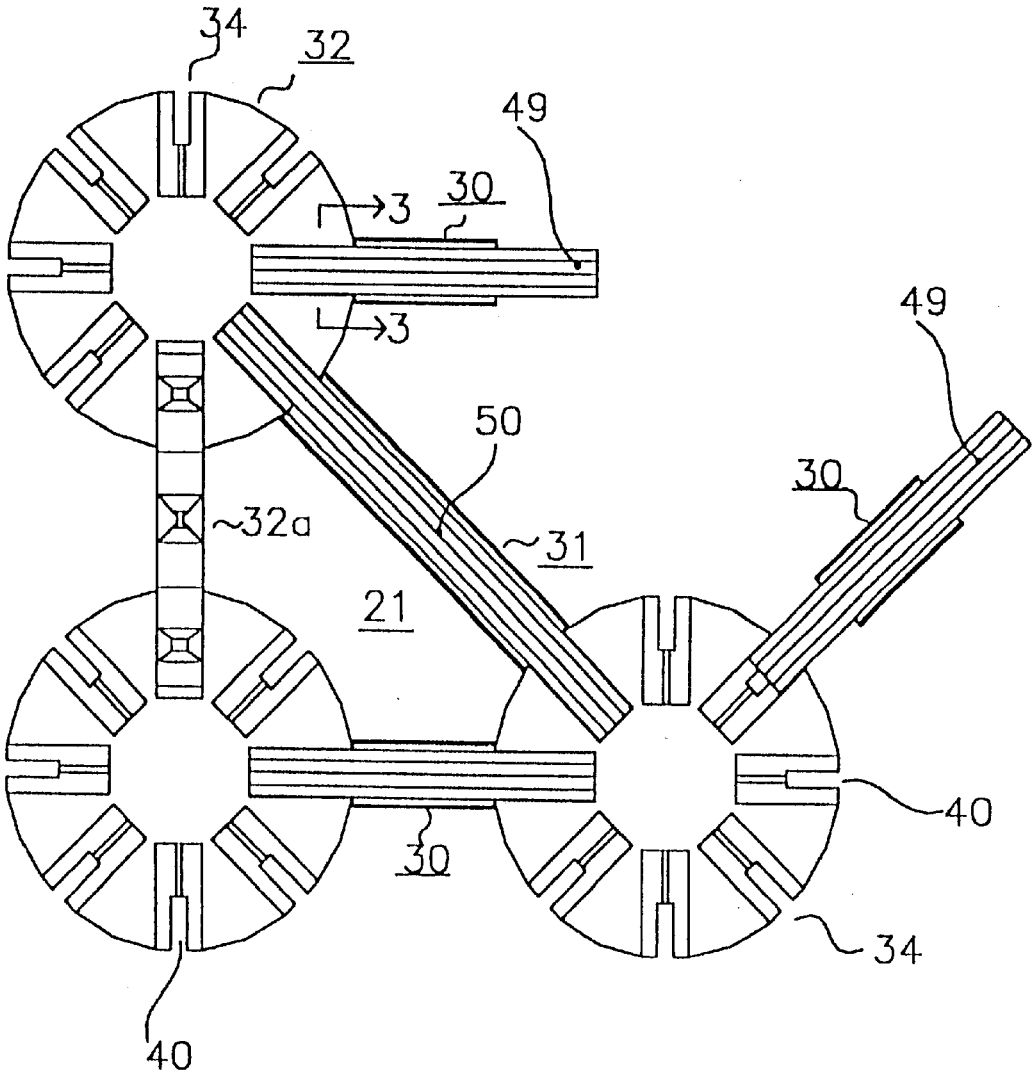

The embodiment of the invention shown in FIGS. 1 thru 6 is a hub and rod construction toy system. FIGS. 1 and 2 show an assembly, generally indicated by 21, in perspective and plan view respectively. Details of their integral genderless connectors are also shown in FIGS. 20*a* and 20*b*. As can be readily seen from the plan view, rods of two different lengths are used to form a right triangle. Shorter rods 30 are of the same length as the diameter of hubs 32. A longer rod 31 is used to form the hypotenuse of the triangle. Hub 32*a* is identical to hubs 32 but is being used instead of a short rod in said assembly. The principal plane of hub 32*a* in assembly 21 is perpendicular to the principal plane of said assembly. In order to better illustrate a hub and rod connection, one of said rods is shown not fully inserted.

Hubs 32 and 32*a* and rods 30 and 31 are cylinders. Said rods are elongated cylinders with two (2) integral genderless connectors 35, one on each end; and with fingers 49 pointing in a direction parallel to the principal axis of the cylinder. Said hubs are flattened cylinders in the form of a disc with eight (8), radially positioned, equally spaced, integral genderless connectors 34 integrally attached to the sides of said cylinder and with fingers 48 perpendicular to the principal axis of the cylinder.

Hub genderless connector 34 and rod genderless connector 35 are functionally identical. A rod then consists of a rod body 50 and two genderless connectors 35. Each genderless connector 35 is composed of two fingers 49 with major axes parallel to the major axis of the rod. Said fingers are joined at the proximal end by a web 26 and separated at the distal end by a slot 23. With hub-rod insertions a distal finger tip 24 of said rods seat against a proximal seat 45 and a distal tip 41 seats against a proximal seat 25. A distal tip 27 of web 26 seats against a distal tip 43 of a hub-connector-web 44. Any of said seatings can act as a stop during hub-rod insertion. A mating surface 22 slides past with a mild interference fit a mating surface 42 and a slot surfaces 28 slides past web 44. Similarly, the slot surfaces 46 slide past the web 26. Slots 23 and 40 must extend at least one half the length of a connection, or more exactly the sum of their lengths must at least equal the length of said connection. If said slots extend the whole length there is then no web. But if one web extends more than half way then said connections are no longer functionally identical and an unnecessary element of gender has been added.

Integral rod connector 35 and integral hub connector 34 are also shown in perspective view and in greater detail in FIGS. 20*a* and 20*b* respectively. An integral hub connector 201 decorated with bumps 202 and pits 203 but otherwise identical to connector 34 is shown in perspective view in FIG. 20*c*. With said bumps and said pits placed as shown, two (2) such identical connectors when mated would be locked together.

In FIG. 3 we show a conplan 33 of a hub-rod connection (hub connector 34 rod connector 35). Hub connector 34 section is shown with oblique hatching. Acute hatching indicates rod connector 35 section. Parting line 36, as can be seen, is in an 'x' shape. More precisely, if parting lines 37 that formed rod mating surfaces 22 and hub mating surfaces 42 are extended until they meet, an 'x' would be formed. Said connector 35 section resembles an hour glass with its upper and lower parts connected by web parting lines 39. Web parting lines 39 do not touch slot parting lines 38.

Figure 4:
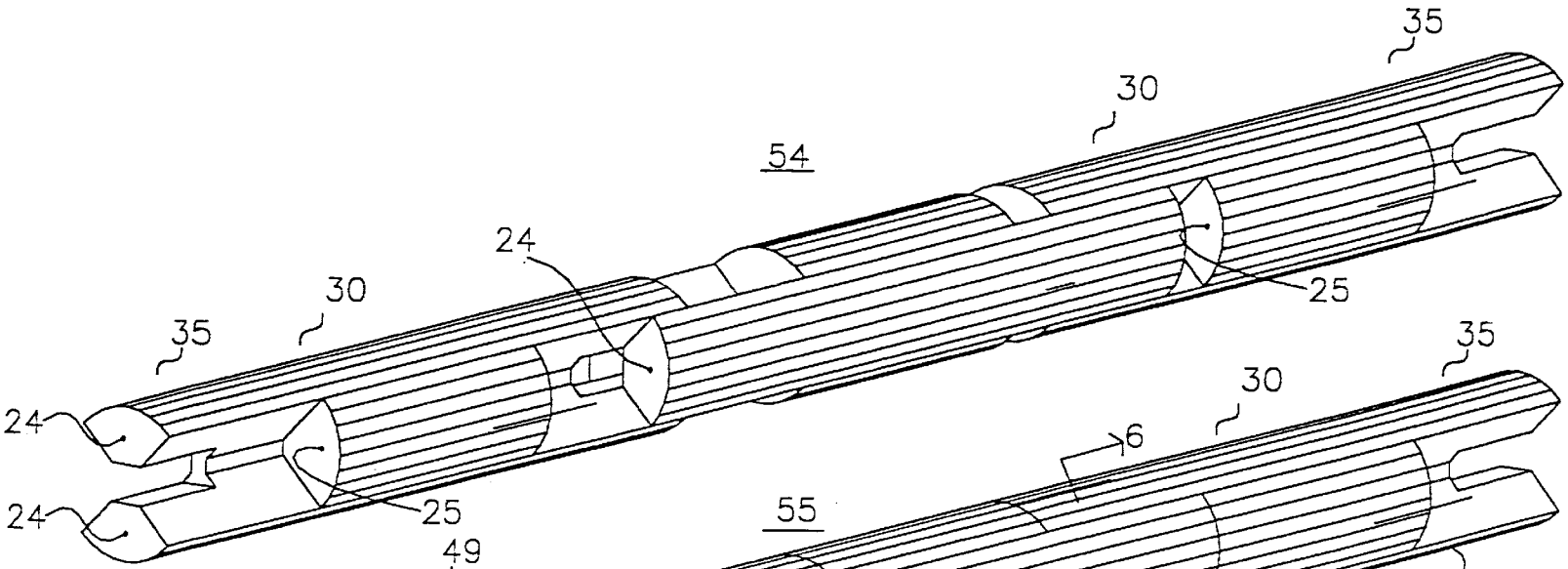
FIGS. 4 and 5 show in perspective view a rod assembled from shorter rods.
Figure 5:
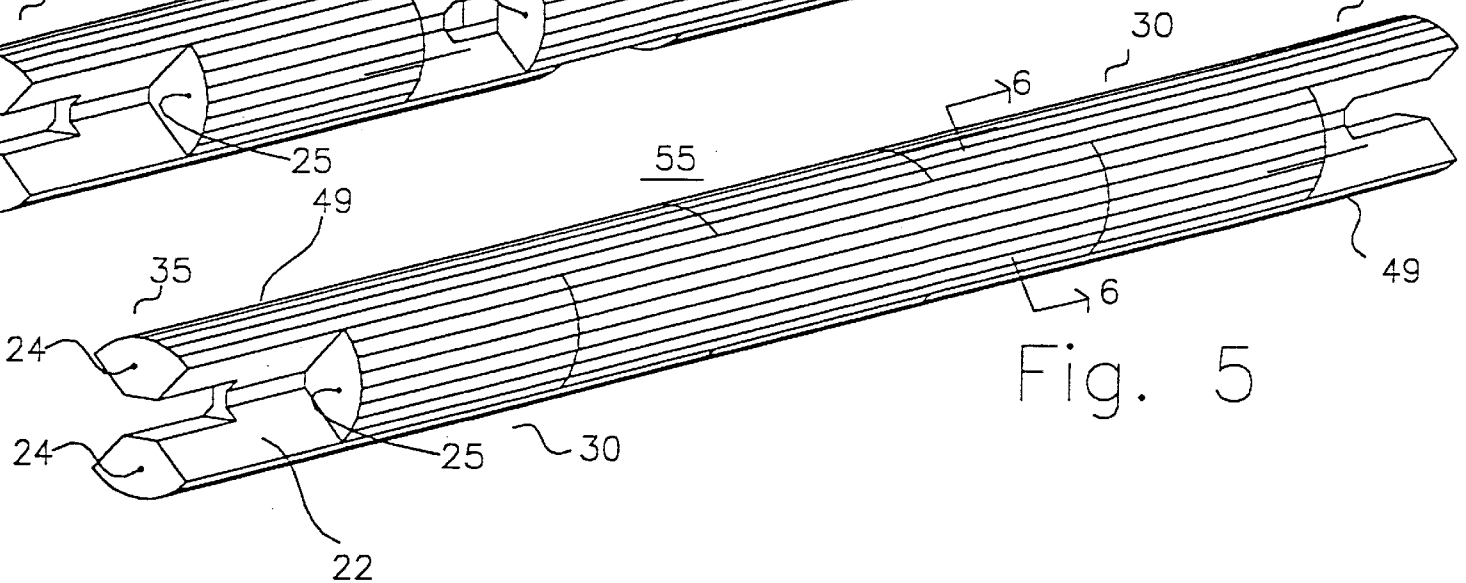

FIGS. 4 and 5 show rod assemblies 54 and 55 assembled from shorter rods 10. With assembly 54 said rods are not fully inserted. Note though that both assemblies 54 and 55 can transmit torque.

Figure 6:
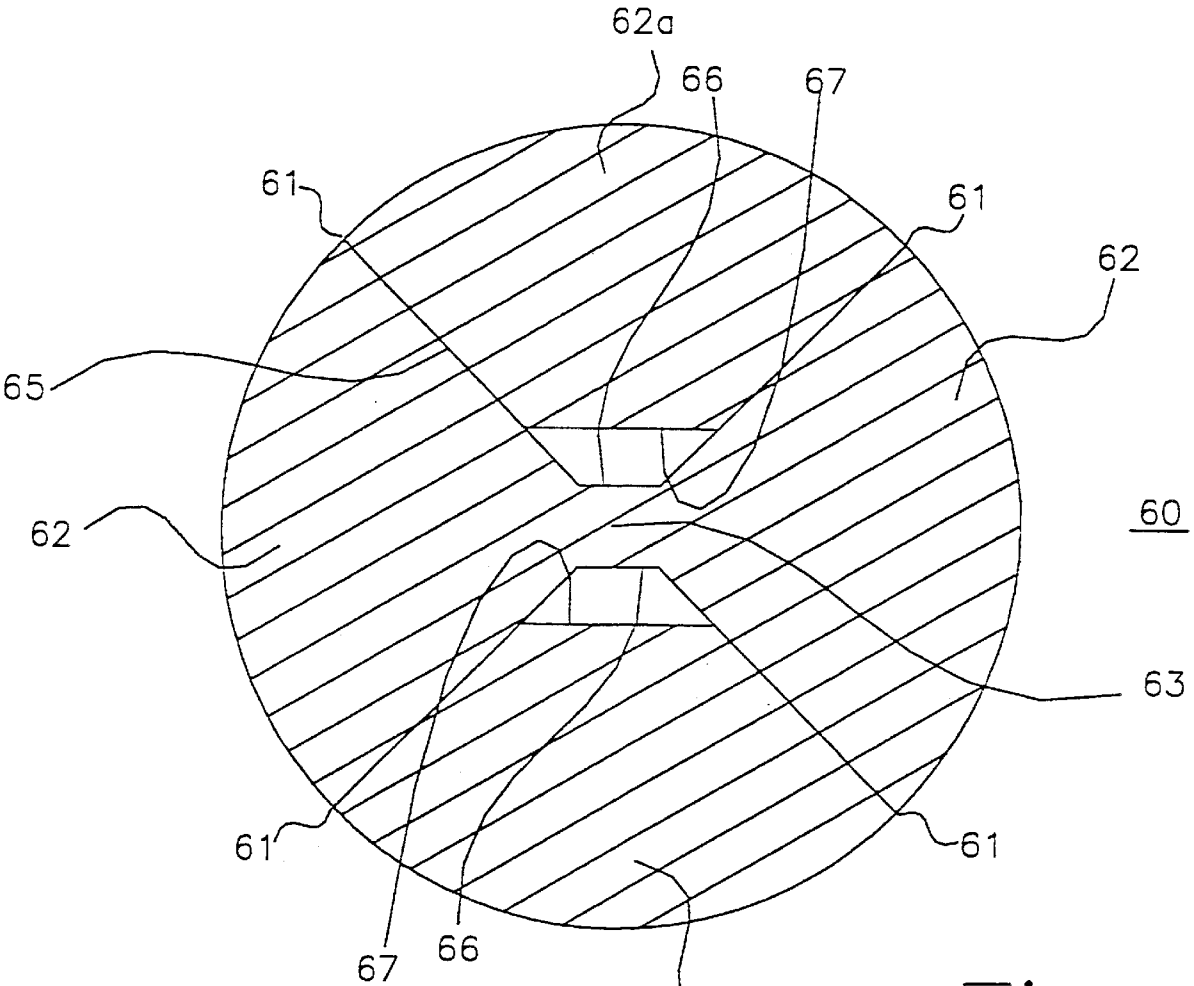
FIG. 6 shows a cross section of the connecting region (conplan) of two of the rods of FIG. 3.

In FIG. 6 we show a conplan 60 of a rod—rod (rod-connector 35—rod-connector 35) mating. That is to say that there are two connectors 35 shown in section. A parting line 61 as can be seen is in an 'x' shape. More precisely, if parting lines 65 that formed rod mating surfaces 22 are extended until they meet, an 'x' would be formed. One of said connector 35 sections (shown with an oblique hatching) resembles an hour glass with upper and lower finger 49 sections 62 connected by a section 63 of web 26. Alternatively, parting lines 65 and web surface parting lines 66, together, trace an hour-glass outline. Slot surface 28 parting line 67 which is part of the other connector 35 section (shown with an acute hatching) does not touch a web surface parting line 66. Slot surface parting lines 67 are also part of finger sections 62*a*. As can be seen, that except for the web 26—slot 23 clearance, when connected to each other, rod connectors 35 form a perfect solid cylinder.

A different rod assembly 70, shown in perspective view in FIG. 7, is composed of rods 30 and 71, of different diameters. The connecting element 76 of rod 70 has two fingers 79 connected by a web and separated by a slot. Each finger ends in a flat distal tip 74. And since this is an integral connector the start of a rod body 77 forms a proximal seat 75.

Figure 8:
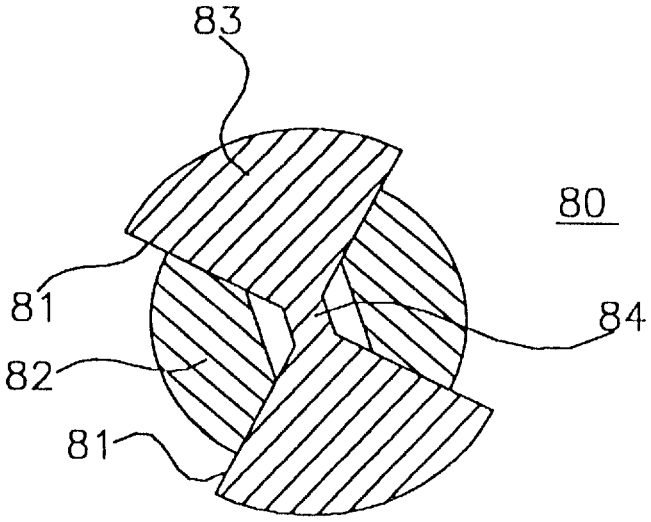
FIG. 8 is the conplan of the embodiment shown in FIG. 7.

But as can be seen with a conplan 80 shown in FIG. 8 that despite the difference in diameter between rod 30 and rod 71, a perfectly serviceable connection is made. In conplan 80 the connector 35 is shown with oblique hatching while connector 76 is shown with acute hatching. A section 84 through the web of connector 76 is in the center and connected to two finger sections 83 of finger 79 and divided by parting line 81 from two finger sections 82 of fingers 49.

Figure 9:
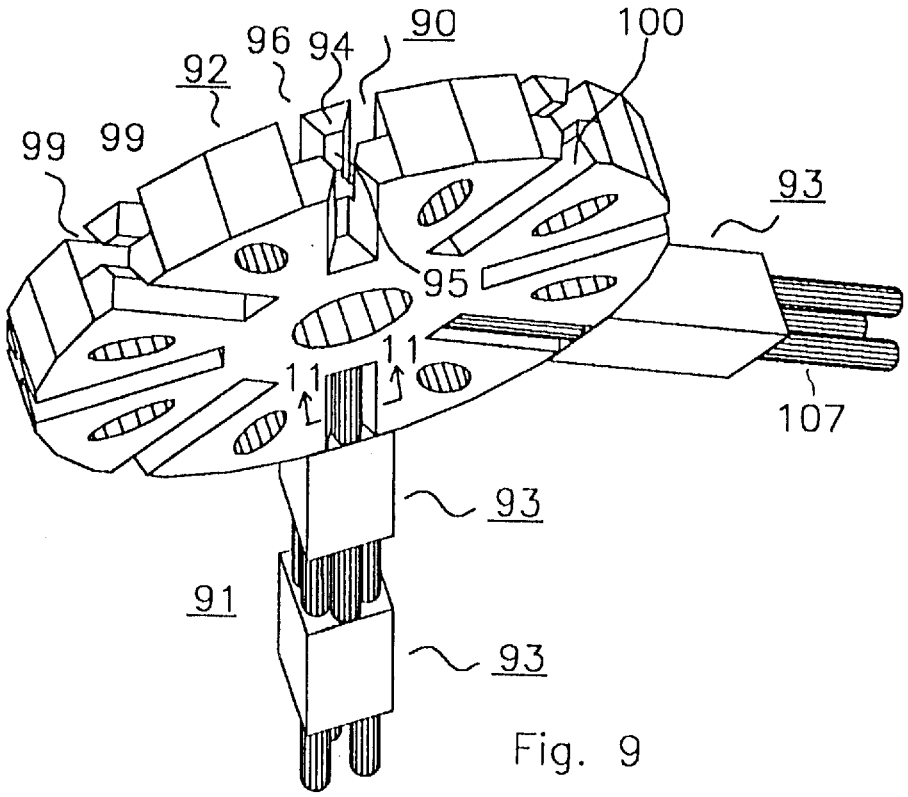
FIGS. 9 and 10 show, in perspective views, rod and hub assemblies that use three fingered genderless connectors.
Figure 10:
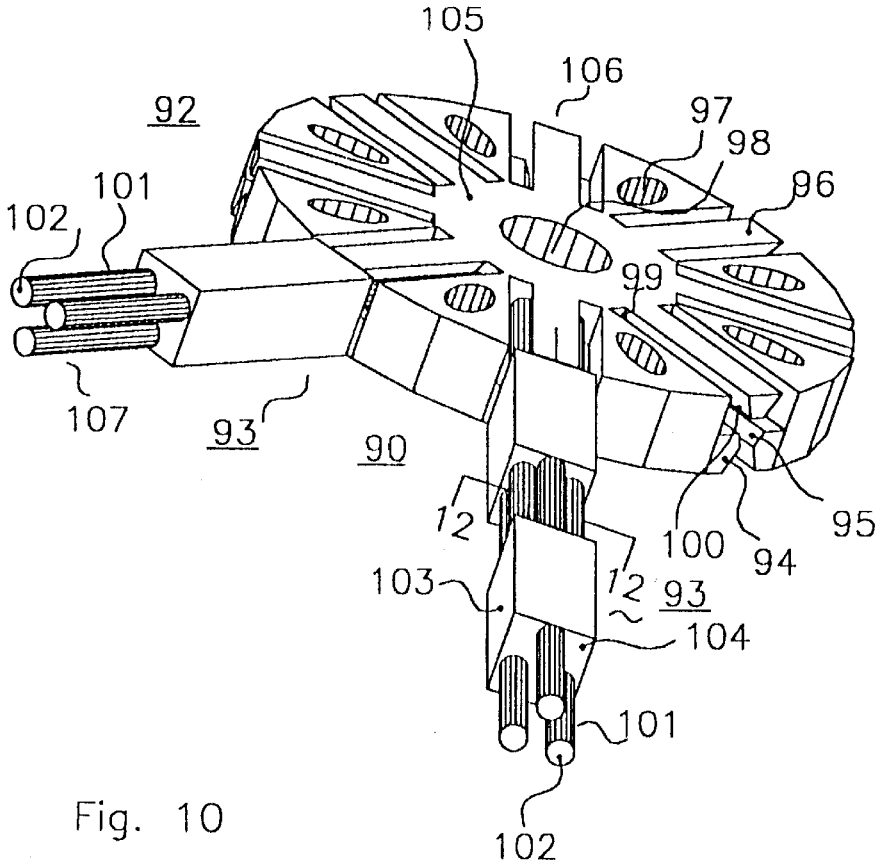

The embodiments disclosed above are all based on a genderless connector that could be characterized as a 'square x'. Their floorplans are all squares; and parting lines in their conplans are in the form of an 'x'. But a connector in the embodiment disclosed in FIGS. 9 thru 12 has an hexagonal floorplan and its parting lines form a six-armed 'x'. We could then call it a 'hex x'. Said embodiment, shown in perspective views in FIGS. 9 and 10, is assembled into a hub and rod assembly 90 with a rod—rod subassembly 91 with a hub 92 and rods 93. A hub connector 106 has fingers 96, with distal tips 94, proximal seat 105, mating surfaces 100, slots 99, web 108 and web tip 109. A rod connector 107, of which each rod is furnished with two, is composed of three cylindrical fingers 101 with distal tips 102. A rod body 93 forms a proximal seat 104. Although connector 107 could have been furnished with a web, it is shown without one. The hub 92 is also furnished with a central transverse hole 98 and eight radially located transverse holes 97.

Figure 11:
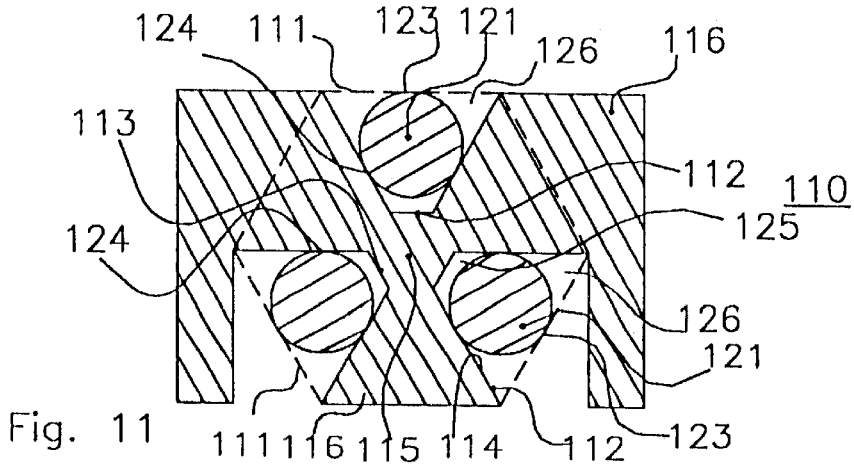

In FIG. 11 we show a conplan 110 of hub connector element 106 connected to rod connector element 107 and with a hexagonal design floorplan 111 shown in dashed lines. Hub connector element 106 is shown with oblique hatching, rod connector element 107 with acute hatching. FIG. 12 shows a conplan 120 of a rod—rod (rod-connector-element 107—rod-connector-element 107) mating, also with floorplan 11 superimposed. A hub connecting element 106 parting line 112 is principally composed of a web surface parting line 113 and a mating surface parting line 114. Three (3) finger 96 sections 116 are joined together by a web 108 section 115. Finger 107 sections 121 have a parting line 122. Finger sections 121, at points 123, are tangent to floorplan 111. At points 124, finger sections 121 are tangent to a hub connector 106 parting line 114 on mating surface 100.

Conplan 120 clearly shows that a rod—rod (rod-connector-107—rod-connector-107) mating is genderless and therefore said rod connector 107 is a genderless connector. But on inspection it should also be evident that a hub—hub (hub-connector-106—hub-connector-106) connection is also genderless, which is to say that said rods could have been furnished with a hub connector 106 instead of a rod connector 107. But conplan 110 shows that the hub-rod (hub-connector-106—rod-connector-107) mating is genderless. But then connectors 106 and connectors 107 are, despite their differences in appearance, effectively identical connectors. Said difference is that in the design of connector 107 some material not strictly necessary for the connection was removed. Void 125 and void 126 indicate regions in which material was removed. While this design strategy does remove material, and does preserve the essential points of contact for the connection, the resulting fingers are not quite as strong and there is less connecting surface area. But note that some of the material removed from the region of void 125 would have been removed for slot clearance.

Embodiments 130 and 140 shown in perspective view in FIGS. 13 and 14 respectively, when molded of flexible material are hubs suited for the construction of geodesics. Hub 130 is furnished with five radially and equally spaced genderless connectors 131 that radiate from a center 142 of said hub like spokes on a wheel. Hub 140 has six of said connectors attached to a hub core 141. Each connector 131 has two fingers 139 with mating surfaces 134. Said fingers are separated by a slot 135 and joined by a web 136. A distal tip 132 of each of said fingers when mated with another connector 131 stops on a proximal seat 133 and mating surfaces 134 slide past each other with a mild interference fit. To construct geodesics, rods similar to rods 30 and 31 but of various lengths, are also required.

An embodiment 150 shown in perspective view in FIG. 15 is a construction block furnished with four genderless connectors 151. Each connector 151 is placed in the center of each of the four vertical sides around a block body 145. Each connector 151 has two fingers 159 with distal tips 152, mating surfaces 154, and slot surfaces 158. Said fingers are separated by a distal slot 155 and joined by a proximal web 156. As can be seen by inspection, two dimensional arrays can be assembled from these blocks. If additional genderless connectors of whatever design were attached to the remaining two faces of block 145 then three-dimensional arrays could be assembled. It can also be noted that within a wide range of sizes, rods similar to rods 30 and 31 can connect to connector 151.

Embodiments 160 and 175 shown in perspective views in FIGS. 16 and 17, respectively, are part of a different building block system. Said embodiments were designed using boolean operations on solids. A rod 177 is either added to or subtracted from a block 161 or a block 176. Said rods are positioned so that exactly half of said rod, which is to say one finger and half a connecting web, is in block 161 and such that the major plane of said rod is perpendicular to the face of the said block that it will decorate. The result of a subtraction is a negative semi-rod channel 163 in block body 161. The result of an addition is a semi-rod 162 attached to a face of block 161. A semi-rod 162 is paired with a channel 163 on each of the four vertical faces of block 160. As can be seen by inspection, said blocks 160 can be formed into two dimensional arrays without the use of any other elements, with each semi-rod 162 on a face of one block mated with a channel 163 on another proximal block. In a compact rectangular array, the only semi-rods 162 and channels 163 not mated are on faces of blocks that are on an edge of said array.

Each semi-rod 162 has two tips 164, a web 166, and two web tips 167. During connection, mating surfaces 170 of semi-rod 162 slide past the surfaces 171 of channel 163 with a web 166 in a slot 165. Web 166 slides past a slot surface 168. Construction block 175, which is shown with rod 177 as a block and rod assembly 173, is constructed slightly differently with semi-rods 162 at each of the four corners. Said semi-rods are also furnished with an optional slot 179 to facilitate mating with rods 30, 31 and 177 and hubs 32 etc. Channels 163 are placed in the middle of said block. Because of the placement of semi-rods 162 at the corners with their major axes at a forty-five (45) degree angle to block body 176, blocks 175 can be used to construct arrays at a forty-five (45) degree angle to arrays constructed with center-connected blocks 160.

An embodiment 181 is shown in perspective view in FIG. 18 as part of a hub—hub assembly 180. It is shown with two hubs 32 attached. Embodiment 181 shows one method of constructing hubs whose connectors 183 are oriented at ninety (90) degrees to connectors 34 of hub 32. Said orientation allows a hub 181 and a hub 32 to be connected with their principal planes parallel. Each connector 183 is furnished with two fingers 184 separated by a distal slot 189 and connected by a proximal web 185. Each connector 183 is attached to a central cylinder 182 at a cylinder wall 188. Said wall serves as a proximal seat for each hub 183—hub 34 et cetera mating. Either a distal tip 187 or a web tip 186 can serve as a stop. A connector 183—hub wall 188 attachment is normal to said hub wall with the principal plane of connector 183 parallel to the axis of central cylinder 182.

Obviously many other arrangements are possible. Central cylinder 182 could be replaced with a rectangular or hexagonal or other cross section prism. The plane of the orientation of connectors 183 could be ninety (90) degrees to that shown or at any arbitrary angle. The relative placement of said connectors could be different. Said connectors are shown in two identical rings of four each with the two rings rotated forty-five (45) degrees to each other. But many other arrangements are possible.

In FIG. 19*b* we show a pair 191 of said profiles 190. If end-mills of said profile were so positioned they would machine a 'perfect connection.' The sides 192 of said profile-pair 191 when extended by the dashed lines 193 meet in a point at the center of the floorplan 194. The web thickness is the same as the reference distance w and is the same as the length of the web face 195. If profile 190 were modified by dashed lines 196 then the web thickness would be the same as reference length w1. In FIG. 19*c* profiles 190 have been moved apart to form a profile pair 197. The web thickness is now greater than reference distance w by the excess of reference distance w2 over reference distance w.

What is claimed is:

1. A construction toy system comprising a plurality of hubs and a plurality of rods:

each of said rods being comprised of an elongated central member and including identical genderless connectors on each end thereof;

each of said hubs being comprised of a substantially flat member lying substantially within a single first plane and including an outer periphery defining the outer extent of said member within said first plane;

each of said hubs including at least three genderless connectors located substantially equally spaced around the outer periphery of said member and extending outwardly from the same substantially in said first plane;

the genderless connectors of said rods and of said hubs being such that rods can be connected to other rods end to end in axial alignment, rods can be connected to hubs so as to extend outwardly therefrom in said first plane and hubs can be connected to other hubs wherein one of said hubs lies in said first plane and a second hub connected thereof through said genderless connectors lies in a second plane perpendicular to said first plane.

2. A construction toy system as set forth in claim 1 wherein each of said hubs has an upper surface and a lower surface which are substantially identical to each other whereby there is no up or down orientation to said hubs.

3. A construction toy system as set forth in claim 1 wherein each of said rods is symmetrical whereby each end is identical to the other end.

* * * * *